United States Patent [19]

Valancius

[11] 4,094,674

[45] June 13, 1978

[54] METHOD OF FIXING A TONER POWDER IMAGE ON A SHEET OF MATERIAL

[75] Inventor: James P. Valancius, Elmhurst, Ill.

[73] Assignee: Addressograph-Multigraph Corporation, Cleveland, Ohio

[21] Appl. No.: 707,773

[22] Filed: Jul. 22, 1976

[51] Int. Cl.[2] ..... G03G 13/20

[52] U.S. Cl. ..... 96/1 SD; 118/120; 427/22; 427/189; 427/195; 427/355

[58] Field of Search ..... 427/22, 195, 189, 444, 427/355; 118/100, 120; 432/197; 96/1 SD

[56] References Cited

U.S. PATENT DOCUMENTS

| | | | |
|---|---|---|---|
| 2,345,941 | 4/1944 | Lehman | 427/355 X |
| 3,623,710 | 11/1971 | Detig | 432/197 |
| 3,754,976 | 8/1973 | Babecki et al. | 427/192 |

FOREIGN PATENT DOCUMENTS

| | | | |
|---|---|---|---|
| 1,060,829 | 3/1967 | United Kingdom | 427/195 |

*Primary Examiner*—Harry J. Gwinnell
*Assistant Examiner*—Stuart D. Frenkel
*Attorney, Agent, or Firm*—Russell L. Root; Sol L. Goldstein

[57] ABSTRACT

A method of fixing a toner powder image on a sheet of material. A substantially flat impact surface is provided, and the side of a sheet opposite to the side carrying a freshly applied toner powder image is placed into contact with the flat impact surface. The surface of the sheet of material carrying the toner powder image is impacted by a plurality of pellets, each of which has an impacting area which is substantially smaller than the area of the surface of the sheet of material carrying the toner powder image. The pellets are preferably repeatedly impacted against the sheet of material and in a random manner to achieve pressure fixing of the entire surface of the sheet of material.

6 Claims, 4 Drawing Figures

METHOD OF FIXING A TONER POWDER IMAGE ON A SHEET OF MATERIAL

BACKGROUND OF THE INVENTION

This application relates to the fixing of a toner powder image on a sheet of material. It has particular application to the fixing of a toner powder image which has been produced by an electrostatic photocopying process.

In an electrostatic photocopying process an image is produced on a sheet of material by the adhesion of toner powder particles to a sheet of material by electrostatic forces. In certain types of electrostatic photocopying processes the image is developed by adhesion of toner particles to a sheet of material which has been treated with a photoconductive material such as zinc oxide and the sheet of material forms the actual copy sheet. In another known form of photocopying process a developed image is subsequently transferred to a sheet of plain paper with the toner powder image initially adhered to the sheet of paper by electrostatic forces.

In the use of either type of photocopying process it is necessary to fix the toner powder image to the sheet of material. Otherwise, the electrostatic forces would not be sufficient to maintain the image on the sheet of material for any appreciable length of time. Heretofore, the conventional ways of fixing the toner powder image on the sheet of material have been by application of heat, pressure or a combination of heat and pressure. The conventional manner of applying pressure has been to pass the sheet of material through a nip formed by a pair of pressure rollers.

SUMMARY OF THE INVENTION

The present invention provides a method of fixing a toner powder image on a sheet of material, which method provides for fixing the image solely through the application of pressure to the sheet of material, and more particularly in a manner which is a considerable departure from the heretofore used application of pressure by a pair of pressure rolls.

According to the invention a substantially flat impact surface is provided, and the side of a sheet opposite to the side carrying the freshly applied toner powder image is placed into contact with the flat inpact surface. The surface of the sheet of material carrying the toner powder image is impacted by a plurality of pellets, each of which has an impacting area which is substantially smaller than the area of the surface of the sheet of material carrying the toner powder image. The pellets are preferably repeatedly impacted against the sheet of material and in a random manner to achieve pressure fixing of the entire surface of the sheet of material.

The method of the present invention is believed to be particularly effective in the fixing of an image on a sheet of material having a fairly rough surface, such as the type of plain bond paper used in certain conventional photocopying processes. This type of paper is generally uneven in consistency, for example in density or compactness, in surface smoothness, or in both. However, by pressure fixing an image in accordance with the present invention the pellets are believed to localize their pressure with each impact in accordance with the contour of the area of the sheet of material which is impacted. This is believed to provide an extremely effective method of pressure fixing a toner powder image on a sheet of material with an uneven surface contour.

BRIEF DESCRIPTION OF THE DRAWINGS

The further objects and advantages of this invention will become further apparent from the following detailed description taken with reference to the accompanying drawings wherein.

DETAILED DESCRIPTION OF THE PREFERRED EMBODIMENT

As noted above the principles of the present invention are particularly applicable for the fixing of a toner powder image which is produced during the photocopying of an image. In the description which follows the principles of the present invention are described in detail as they are applied during such a photocopying process. However, from the following description the manner in which the principles of the present invention can be applied to fix a toner powder image produced in other contexts will become readily apparent to those of ordinary skill in the art.

Figure 1:
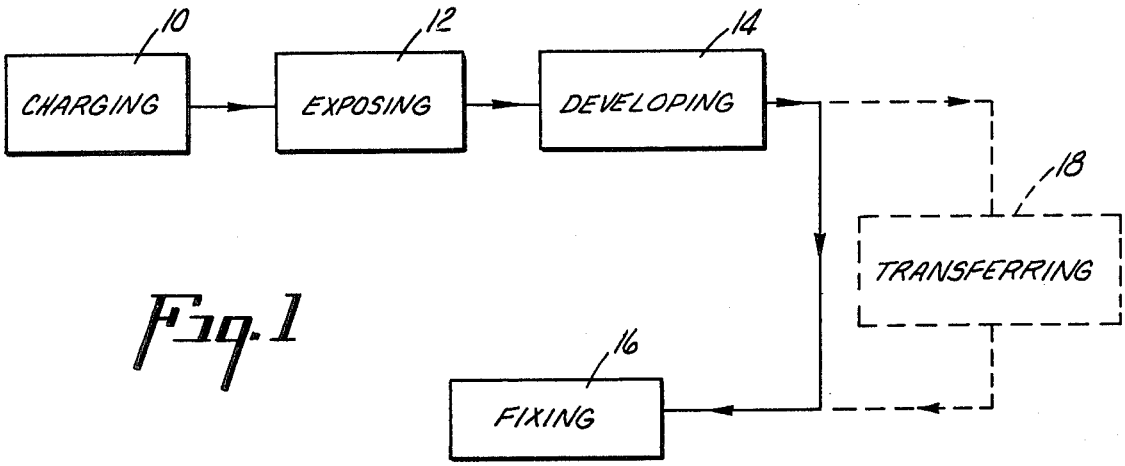
FIG. 1 is a schematic representation of the general sequence of steps which are involved in the photocopying of an image.

FIG. 1 schematically illustrates the general sequence of steps by which an image is copied by means of a photocopying process. Referring specifically to the sequence of events illustrated by the solid line flow diagram a sheet of material, which has been treated with a photoconductive material such as zinc oxide, is electrostatically charged at a charging station 10. The charged sheet of material is then transferred to an exposing station 12 at which the charged sheet of material is exposed to a projection of the image which is to be copied. The sheet of material then passes to a developing station 14.

In certain photocopying processes the photoconductive sheet of material actually becomes the copy. In such types of processes the image is developed at developing station 14 by application of toner powder particles to the charged areas of the sheet after exposure. The sheet of material then passes directly to fixing station 16 whereat the image is fixed. This is represented in solid lines in the flow diagram of FIG. 1.

In other photocopying processes (called "plain paper copying") a developed image is transferred to a transferring station 18 (shown in dashed lines) at which a toner powder image is transferred to a charged sheet of plain paper. The sheet of plain paper then passes to fixing station 16.

Figure 2:
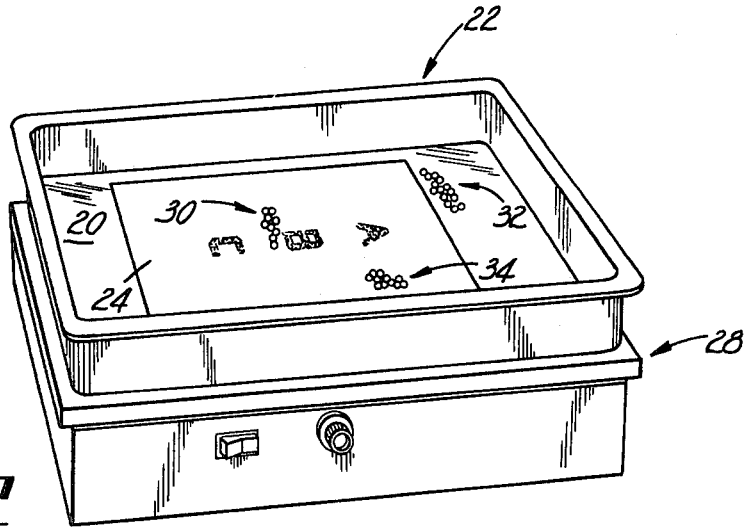
FIG. 2 is a perspective view of an apparatus for fixing an image in accordance with the principles of the present invention.

FIG. 2 illustrates apparatus for fixing the toner powder image to the sheet of material in accordance with the principles of the invention. An impact surface is formed by the bottom surface 20 of a tray 22. The sheet of material 24 carrying the toner powder image (forming the letters "A", "B" and "C" in the illustration) is manually disposed on the impact surface 20 with the side of the sheet carrying the toner powder image facing away from surface 20.

A plurality of compact pellets are provided, each of which has an impacting area which is substantially smaller than the area of the surface of the sheet of material 24. By compact pellets is meant pellets whose surface area approaches a minimum value for their volume, i.e. which do not greatly deviate from spherical in shape. The plurality of pellets are impacted against the sheet of material disposed on the impact surface 20. In the preferred embodiment the pellets are formed by a series of spherical metal elements 26 (conventionally referred to as BBs). The preferred embodiment of this invention further contemplates pellets weighing approximately 0.35 grams apiece and dimensioned to provide an impact area of one-tenth of a square millimeter.

Figure 3:
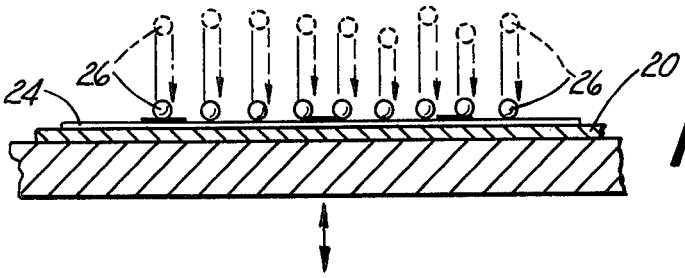
FIG. 3 is a fragmentary sectional view of a portion of the apparatus of FIG. 2, and illustrating the manner in which the apparatus of FIG. 2 fixes an image in accordance with the principles of the present invention.

In the illustrated embodiment of FIGS. 2 and 3 the pellets 26 are initially disposed on top of the surface of sheet 24 and they are impacted against the sheet 24 by oscillating the impact surface 26 in a direction which is substantially normal to the impact surface 20. Referring to FIG. 2, tray 22 is disposed on top of a conventional shaker table 28 which is oscillated with an up and down motion by conventional means (not shown). While only small groups 30, 32 and 34 of pellets are shown in FIG. 2 it is contemplated that the actual number of pellets used would be enough to cover approximately 60% of the area of sheet 24.

With the pellets 26 disposed on top of sheet 24 the shaker table 28 is oscillated with a substantially up and down motion. The preferred rate of oscillation is 120 cycles per second for pellets of the size set forth above and the amplitude of oscillation is preferably set so that the pellets are projected approximately 2 inches above the surface 20. As they are oscillated in this manner, the pellets 26 effectively impact the sheet of material 24 with enough force to fix the image to the sheet of material.

The impacting of the pellets against the sheet 22 is repeated through the repeated oscillation of the shaker table. The movement of the pellets tends to also become somewhat random in relation to the impact surface 20. The net result of this random movement is that the pellets, through repeated oscillation and their random movement relative to surface 20 serve to effectively impact the entire area of the sheet of material.

It should be recognized, of course, that the specific size of the pellets, their specific weight, and the most desirable oscillation rate and amplitude may vary in accordance with various equipment designs. This specific disclosure is intended solely to provide a complete description of what has heretofore been found to provide the best mode of operation.

It is believed that the process of fixing an image disclosed above is particularly effective at fixing an image on an uneven sheet of paper, such as plain bond copy paper. In photocopying processes where the sheets of material which have the photoconductive coating applied thereto also form the copy sheets, the coating of photoconductive material tends to smooth the overall consistency of the copy sheet. The fixing of such an image by conventional pressure rolls may be quite satisfactory for this purpose. In the situations where plain copy paper having a less even consistency is used, there is always the potential problem that the toner powder particles would be pressed into the thick spots of the copy paper but not well pressed into the other lower or less dense spots. By virtue of the present invention the impacting of the sheets through pellets whose contact area is relatively small in relation to the surface of the sheet and whose motion is somewhat random it is believed that the pellets are capable of effectively impacting the lower or less dense spots as well as the higher or denser spots. In this way the impacting of the entire sheet should be complete regardless of any unevenness which may exist in the consistency of the sheet.

Figure 4:
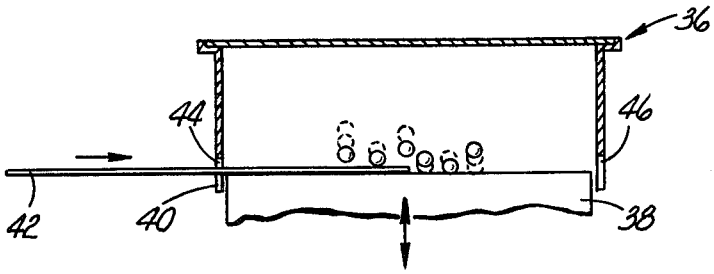
FIG. 4 is a partial sectional view of an apparatus for practicing a modified form of the method of the present invention.

A modified form of process according to the present invention is shown in FIG. 4. In this invention a fixed housing 36 substantially encloses the upper surface of an oscillating table 38. A slot 40 is formed in the fixed housing 36 and sheets of material 42 having a toner powder image applied thereto are conveyed from the developing or transferring station and fed automatically through the slot 40 and onto the oscillating table 38. The slot 40 has an upper limiting edge 44 which is disposed above the maximum height to which the table 38 is oscillated, and the edge 44 of the slot is also disposed above the minimum height of the oscillating table by a distance which is less than the diameter or minimum dimension of the pellets. The sheet of material 42 carrying the toner powder image can be fed into the slot 40 while the table is oscillating and can be fed out of another similar slot 46 in the housing after the toner powder image is fixed, preferably as a continuous process.

With the foregoing disclosure in mind, many and varied obvious modifications of this disclosure, employing the principles of the present invention will become readily apparent to those of ordinary skill in the art.

What is claimed is:

1. A method of fixing to a sheet of paper a toner powder image applied to a first side thereof comprising the steps of:

providing an impact member having a hard smooth impact surface;

placing the side of the sheet of paper which is opposite to the first side into contact with said impact surface;

providing a plurality of compact, hard surfaced pellets each of which has an impacting area which is substantially smaller than that area of said sheet of paper carrying the toner powder image;

imparting kinetic energy to the pellets; and impacting the first side of said sheet of paper with the thus energized pellets to pressure fix the toner powder image thereto.

2. A method as set forth by claim 1 in which the steps of imparting and impacting are effected by disposing a plurality of said pellets on said first surface, and oscillating said impact member to agitate said plurality of pellets for repeatedly impacting said sheet of material between said pellets and said impact surface.

3. A method as set forth by claim 2 wherein the step of oscillating comprises so oscillating the impact member that at least a substantial component of its motion is in a direction which is normal to said impact surface.

4. A method as defined in claim 2 wherein the step of placing the sheet on the impact surface comprises automatically transferring the sheet from a conveying means to said impact surface while said impact surface is being oscillated with the pellets thereon.

5. In a method of producing a toner powder image by exposing a photoconductive member to a projection of an image, developing the image, and producing a copied image by adherence of toner powder particles to a first side of a sheet of paper, the improvement comprising the steps of:

providing an impact member having a hard, smooth impact surface;

placing the side of the sheet of paper which is opposite to the first side into contact with said impact surface;

providing a plurality of compact, hard surfaced pellets each of which has an impacting area which is substantially smaller than that area of said sheet of paper carrying the toner powder image;

imparting kinetic energy to the pellets; and impacting the first side of said sheet of paper with the thus energized pellets to pressure fix the toner powder image thereto.

6. A method as set forth in claim 5 in which the steps of imparting and impacting are effected by disposing a plurality of said pellets on said first surface and so oscillating the impact member that at least a substantial component of its motion is in a direction which is substantially normal to said impact surface to agitate the plurality of pellets so that they repeatedly impact said sheet.

* * * * *